US007318634B2

(12) United States Patent
Moon

(10) Patent No.: US 7,318,634 B2
(45) Date of Patent: Jan. 15, 2008

(54) APPARATUS AND METHOD OF DRIVING AND INK JET PRINTER FOR MANUFACTURING A DISPLAY DEVICE

(75) Inventor: Seong Hak Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 285 days.

(21) Appl. No.: 10/974,978

(22) Filed: Oct. 28, 2004

(65) Prior Publication Data

US 2005/0093897 A1 May 5, 2005

(30) Foreign Application Priority Data

Nov. 4, 2003 (KR) ..... 10-2003-0077610
Nov. 6, 2003 (KR) ..... 10-2003-0078389
Dec. 10, 2003 (KR) ..... 10-2003-0089831

(51) Int. Cl.
*B41J 29/38* (2006.01)

(52) U.S. Cl. ..... 347/5; 347/9; 347/12

(58) Field of Classification Search ..... 347/2, 347/5, 9, 10, 12, 11, 56, 58
See application file for complete search history.

(56) References Cited

U.S. PATENT DOCUMENTS 4,521,786 A * 6/1985 Bain ..... 347/10
4,982,199 A * 1/1991 Dunn ..... 347/15

* cited by examiner

*Primary Examiner*—Lam Son Nguyen
(74) *Attorney, Agent, or Firm*—Ked & Associates, LLP

(57) ABSTRACT

The present invention relates to an ink jet printer for display device fabrication, and more particularly, to an apparatus and a method of driving an ink jet printer for manufacturing a display device. According to a first embodiment of the present invention, an apparatus of driving an ink jet printer for manufacturing a display device includes a timing control unit outputting a timing control signal by receiving a prescribed signal (IN) inputted from outside, a head drive unit receiving the timing control signal outputted from the timing control unit and a prescribed drive voltage (Vh), the head drive unit outputting a drive pulse of a predetermined voltage level, and an array resistor outputting a head drive voltage to a plurality of heads by receiving the drive pulse outputted from the head drive unit, wherein the head drive voltage outputted from the array resistor maintains a predefined voltage value. Therefore, the sustainability and reliance of the head can be enhanced by preventing the ink blocking or missing channel in a manner of equalizing the frequency of the drive pulse applied in printing the ink to that of the printing pulse applied in the standby mode and consecutively applying the drive and priming pulses of the same frequency to equalize the ink circulation condition.

14 Claims, 12 Drawing Sheets

APPARATUS AND METHOD OF DRIVING AND INK JET PRINTER FOR MANUFACTURING A DISPLAY DEVICE

This Nonprovisional application claims priority under 35 U.S.C. § 119(a) on Patent Application No. 10-2003-0077610 filed in Korea on Nov. 4, 2003, Patent Application No. 10-2003-0078389 filed in Korea on Nov. 6, 2003, and Patent Application No. 10-2003-0089831 filed in Korea on Dec. 10, 2003, the entire contents of which are hereby incorporated by reference.

BACKGROUND OF THE INVENTION

1. Field of the Invention

The present invention relates to an ink jet printer for display device fabrication, and more particularly, to an apparatus and a method of driving an ink jet printer for manufacturing a, display device.

2. Description of the Background Art

Recently, in accordance with the developments and wide spread of information processing systems, importance of a display device as a visual information transfer means rises. Specifically, a cathode ray tube (CRT) has a big size, a high operational voltage, and such a technical difficulty as display distortion and the like, thereby failing to meet the recent tendency toward wide size and flatness of screen. Hence, many efforts are made to develop various flat display devices having a matrix structure each.

A plasma display panel (hereinafter abbreviated PDP) as a flat display device displays pictorial images including characters and graphics in a manner of exciting phosphor to emit light by ultraviolet rays generated from discharge of inert gas such as He+Xe and Ne+Xe. The PDP facilitates to enable a wide-screen and has such a feature as high display quality and fast response speed. And, the PDP enables its thin and slim-size implementations, thereby coming into the spotlight to be used for a wall-hanging display device.

In fabricating the PDP, printing or other photography processes are generally used in coating phosphor or electrodes. Yet, these processes are expensive as well as put limitation on resolution.

In order to overcome such limitation, to reduce costs, and to enhance high precision, some manufacturers intend to use ink jet printing. A device for driving an ink jet printer for display device fabrication according to a related art, as shown in FIG. 1, is explained as follows.

FIG. 1 is a configurational block diagram of a device for driving an ink jet printer for display device fabrication according to a related art. Referring to FIG. 1, a device for driving an ink jet printer for display device fabrication according to a related art consists of a DC/DC converter 40 outputting a prescribed drive voltage $V_h$, a timing controller 10 outputting a timing control signal by receiving a prescribed signal IN inputted from outside, a head driver 20 outputting a drive pulse by receiving the timing control signal outputted from the timing controller 10 and the prescribed drive voltage $V_h$, and an array resistor 30 receiving the drive pulse outputted from the head driver 20 to output a signal (head drive voltage) having a voltage at a prescribed level to a head.

An operation of the above-configured device for driving the ink jet printer for display device fabrication according to a related art is explained as follows.

FIG. 2 is a diagram for explaining an operation mode and standby mode for the device for driving the ink jet printer for display device fabrication according to the related art.

Referring to FIG. 2, once the prescribed signal IN for driving the head is inputted from outside, the timing controller 10 receives the signal IN to output the timing control signal having a prescribed frequency.

The head driver 20 receives the timing control signal outputted from the timing controller 10 and the prescribed drive voltage $V_h$ outputted from the DC/DC converter 40 and then outputs the drive pulse having the level of the drive voltage $V_h$. In doing so, the frequency of the drive pulse is equal to that of the timing control signal. For instance, if the drive voltage $V_h$ is 40V and if the frequency of the timing control signal is 3 KHz, the head driver 20, as shown in (a) of FIG. 2, outputs the drive pulse of 2 KHz at 40V.

Thus, the drive pulse outputted from the head driver 20 is inputted to the array resistor 30. The drive pulse is then converted according to a resistance of the array resistor 30 and a condenser value of the head connected to the array resistor 30 to be inputted to each head. In doing so, a frequency and voltage of the head drive voltage applied to the head are also equal to those of the drive pulse, respectively.

Once the head drive voltage is applied to the head, ink is jetted from a nozzle, which is a sort of hole for jetting the ink, constructing the head to print a pattern of phosphor, electrode, or the like.

On the other hand, if the ink jet printer fails to operate or is in standby mode, i.e., if the external input signal IN fails to be inputted, any kind of voltage, as shown in (b) of FIG. 2, is not applied to the head since there exists no drive pulse signal outputted from the head driver 20.

When the head drive voltage fails to be applied to the head, the ink fails to circulate to precipitate so that the nozzle may be blocked or a state of the nozzle can be changed. In case that the nozzle is blocked in the course of jetting the ink, a missing channel may be brought about.

In order to solve the above-mentioned problems, the related art method of driving the ink jet printer intends to prevent the blocked nozzle and the missing channel in a manner of applying a priming pulse having a frequency different from that of the drive pulse in the standby mode, i.e., a pulse enabling to circulate the ink instead of jetting the ink. Yet, in the related art method, since the frequency of the drive pulse on printing is different from the frequency of the priming pulse after the printing, the condition for circulating the ink is varied to affect the ink jet. Hence, the ink blocking or missing channel may take place.

Moreover, the DC/DC converter 40 of the related art device for driving the ink jet printer for display device fabrication keeps outputting the prescribed drive voltage $V_h$ regardless of a presence or non-presence of the connection to the head. Hence, if the head is not connected, a bad influence may be put on the system.

Meanwhile, even if the same drive voltage is applied to the head driver 20, there exists a difference of voltage substantially applied to the head due to the resistance difference according to the characteristics or use of each head.

Thus, once the difference of the voltage applied to each head takes place, the voltage difference varies a jetting speed of the ink jetted from the head to differentiate an ink jet amount according to each head. Hence, brightness reduction of the panel and the difference in uniformity take place after pattern printing, which is shown in FIG. 3.

FIG. 3 is a diagram of a pattern according to a signal applied to each head of the related art device for driving the ink jet printer for display device fabrication.

Referring to FIG. 3, in applying the same drive voltage $V_h$ to the head driver, if the voltages applied to head-1, head-2, and head-3 are 40V, 45V, and 35V, respectively due to the resistance difference between the respective heads, a pattern by the head-2 is thickest and a pattern by the head-3 is thin. Hence, the uniformity difference occurs.

Meanwhile, as mentioned in the above explanation, even if the same drive voltage is applied to the head driver 20, the ink amount jetted from the nozzle may vary due to the different features of a plurality of piezos configuring the respective heads, respectively instead of the difference between the voltages substantially applied to the heads, respectively.

FIG. 4 is a diagram of a waveform applied to a piezo configuring each head of the related art device for driving the ink jet printer for display device fabrication. Referring to FIG. 4, in case that there are thirty-two piezos configuring a head, slopes of drive waveforms or voltages applied to the channels (piezos) differ from each other, whereby an amount of ink jetted from a nozzle varies.

In case that the ink jet amount varies, the missing channel occurs to degrade the pattern uniformity.

SUMMARY OF THE INVENTION

Accordingly, an object of the present invention is to solve at least the problems and disadvantages of the background art.

An object of the present invention is to provide an apparatus for driving an ink jet printer for manufacturing a display device, by which pattern uniformity can be enhanced by controlling an output of a head drive voltage according to a presence or non-presence of head connection and by controlling a head drive voltage level according to a resistance value of a connected head.

Another object of the present invention is to provide an apparatus for driving an ink jet printer for manufacturing a display device, by which pattern uniformity can be enhanced by preventing a missing channel in a manner of compensating a difference of voltage applied to a corresponding piezo configuring a head.

Another object of the present invention is to provide an apparatus for driving an ink jet printer for manufacturing a display device and method thereof, by which sustainability and reliance of a head can be enhanced by preventing an ink blocking or a missing channel in a manner of adjusting a frequency of a pulse applied in an operation or standby mode of the ink jet printer for the display device fabrication.

According to a first embodiment of the present invention, an apparatus of driving an ink jet printer for manufacturing a display device includes a timing control unit outputting a timing control signal by receiving a prescribed signal (IN) inputted from outside, a head drive unit receiving the timing control signal outputted from the timing control unit and a prescribed drive voltage (Vh), the head drive unit outputting a drive pulse of a predetermined voltage level, and an array resistor outputting a head drive voltage to a plurality of heads by receiving the drive pulse outputted from the head drive unit, wherein the head drive voltage outputted from the array resistor maintains a predefined voltage value.

According to a second embodiment of the present invention, an apparatus of driving an ink jet printer for manufacturing a display device includes a head drive unit driving at least one head by receiving a prescribed drive voltage to output a drive pulse via an array resistor, a time delay unit receiving a prescribed trigger signal for head driving and outputting a timing control signal delayed by a prescribed time, and a push/pull drive unit outputting a priming pulse via the array resistor to the head by the timing control signal outputted from the time delay unit, wherein the priming pulse having a same frequency of the head drive pulse circulates ink instead of jetting the ink.

According to a second embodiment of the present invention, a method of driving an ink jet printer for manufacturing a display device includes the steps of applying a drive pulse having a prescribed frequency and a drive voltage for printing ink to a head and applying a priming pulse having the prescribed frequency of the drive pulse and a prescribed priming voltage to the head after completion of applying the drive pulse.

In an apparatus and a method of driving an ink jet printer for manufacturing a display device according to the present invention, the uniformity can be enhanced by compensating the voltage difference between the heads in a manner of controlling the output of the head drive voltage according to a presence or non-presence of head connection and controlling the head drive voltage level according to the resistance difference of the connected head. And, the pattern uniformity can be enhanced by preventing the missing channel occurrence in a manner of applying the same drive waveform to the piezos regardless of the features of the respective piezos. Moreover, the sustainability and reliance of the head can be enhanced by preventing the ink blocking or missing channel in a manner of equalizing the frequency of the drive pulse applied in printing the ink to that of the printing pulse applied in the standby mode and consecutively applying the drive and priming pulses of the same frequency to equalize the ink circulation condition.

BRIEF DESCRIPTION OF THE DRAWINGS

The invention will be described in detail with reference to the following drawings in which like numerals refer to like elements.

DETAILED DESCRIPTION OF PREFERRED EMBODIMENTS

Figure 1:
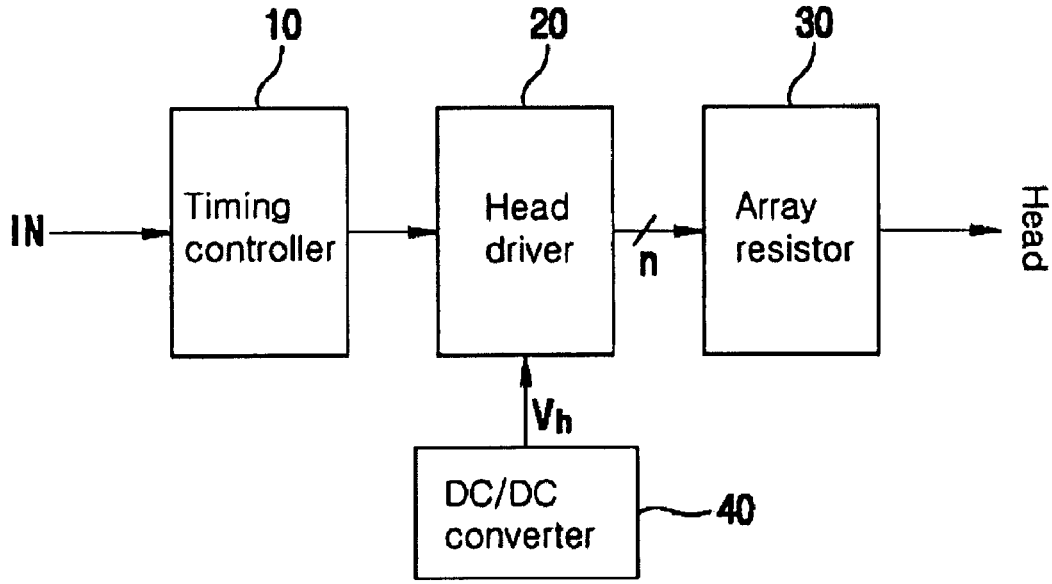
FIG. 1 is a configurational block diagram of a device for driving an ink jet printer for display device fabrication according to a related art.
Figure 2:
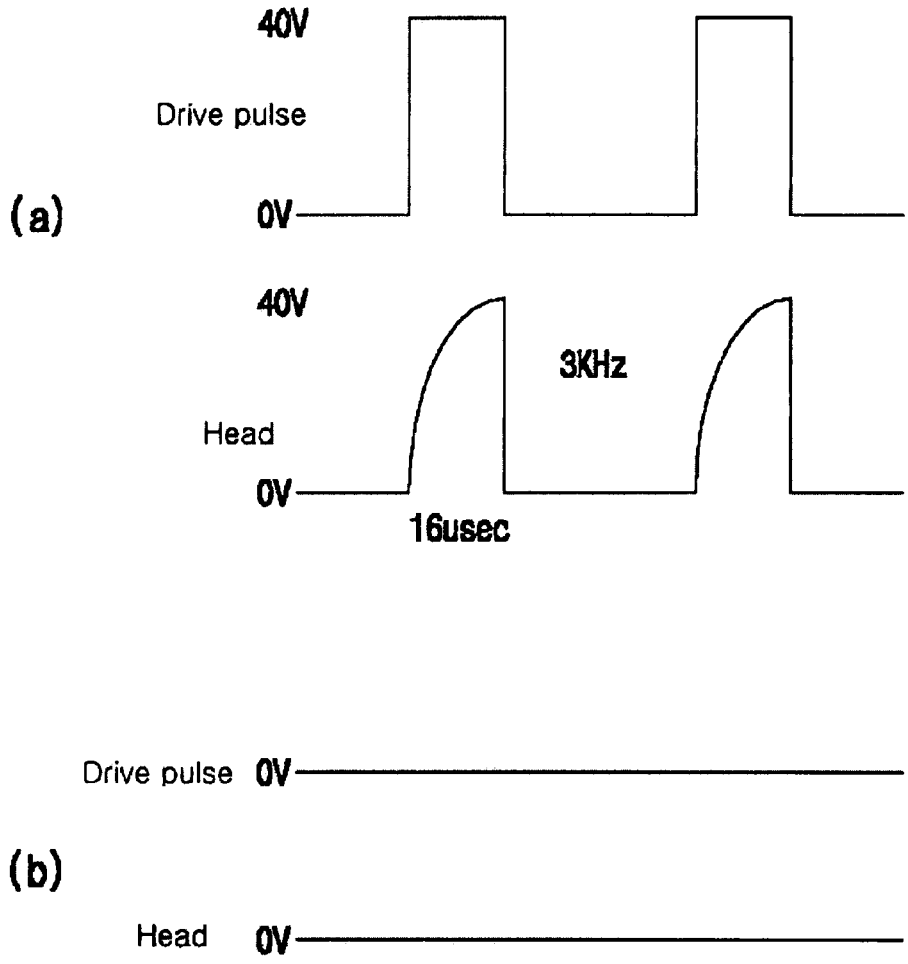
FIG. 2(*a*) and FIG. 2(*b*) are a diagram for explaining an operation mode and standby mode for a device for driving an ink jet printer for display device fabrication according to a related art.

Preferred embodiments of the present invention will be described in a more detailed manner with reference to the drawings.

First Embodiment

According to a first embodiment of the present invention, an apparatus of driving an ink jet printer for manufacturing a display device includes a timing control unit outputting a timing control signal by receiving a prescribed signal (IN) inputted from outside, a head drive unit receiving the timing control signal outputted from the timing control unit and a prescribed drive voltage (Vh), the head drive unit outputting a drive pulse of a predetermined voltage level, and an array resistor outputting a head drive voltage to a plurality of heads by receiving the drive pulse outputted from the head drive unit, wherein the head drive voltage outputted from the array resistor maintains a predefined voltage value.

The prescribed drive voltage (Vh) is supplied from a DC/DC converting unit and an output voltage control unit so that the head drive voltage outputted from the array resistor can be maintained at the predefined voltage value by the head drive unit.

The DC/DC converting unit outputs the prescribed drive voltage to the head drive unit by receiving a switching control signal and a voltage level control signal. The output voltage control unit outputs a switching-on/off control signal according to a presence or non-presence of a connected state of the head to the DC/DC converting unit by receiving the prescribed drive voltage outputted from the DC/DC converting unit. And, the output voltage control unit outputs the voltage level control signal to the DC/DC converting unit to enable the head drive unit to output the head drive voltage in case of the presence of the connected state of the head.

The output voltage control unit includes a head detecting unit turning on/off a connection to the head by detecting the presence or non-presence of the connected state of the head, first and second resistors distributing the drive voltage (Vh) outputted from the DC/DC converting unit, a switching control unit outputting the switching-on/off control signal to the DC/DC converting unit by receiving a voltage caught on the second resistor and a predefined second reference voltage (Vref2), and a voltage level control unit outputting the prescribed voltage level control signal to the DC/DC converting unit by receiving the voltage caught on the second resistor and a predefined first reference voltage (Vref1) to enable the head drive unit to output the predefined head drive voltage.

In case that the connection to the head is turned on, a resistor of the connected head and the second resistor are connected parallel.

The head drive voltage outputted from the array resistor is generated from the head drive unit to be applied to each of a plurality of piezos included in the head.

The head drive unit includes a plurality of drive pulse applying units and each of the drive pulse applying units generates a prescribed constant current by detecting a pulse of the drive voltage inputted to a piezo and applies the prescribed drive voltage ($V_h$) and a drive pulse having the prescribed constant current to the piezo via a resistor by the received timing control signal.

The drive pulse applying unit includes a voltage detecting unit outputting a prescribed voltage by detecting the pulse of the head drive voltage applied to the piezo, a piezo current control unit comparing the prescribed voltage outputted from the voltage detecting unit to a predefined reference voltage (Vref) and outputting the constant current corresponding to a difference resulting from the comparison and the drive voltage ($V_h$) inputted from outside, and a piezo drive unit receiving the drive voltage ($V_h$) and the prescribed constant current outputted from the piezo current control unit and applying the drive pulse having the drive voltage ($V_h$) and the prescribed constant current to the piezo via the resistor by the timing control signal inputted from outside.

The piezo current control unit includes a constant current control unit outputting a prescribed constant current control signal by comparing the prescribed voltage outputted from the voltage detecting unit to the predefined reference voltage (Vref) and a constant current unit outputting the prescribed constant current generated from the prescribed drive voltage ($V_h$) inputted from outside and the constant current control signal inputted from the constant current control unit to the piezo drive unit.

And, the piezo drive unit includes a plurality of switching means for outputting the drive voltage $V_h$) and the prescribed constant current outputted from the constant current unit via the resistor to the piezo by being controlled by the timing control signal inputted from outside.

Hereinafter, a first embodiment of the present invention will be described with reference to the drawings.

Figure 5:
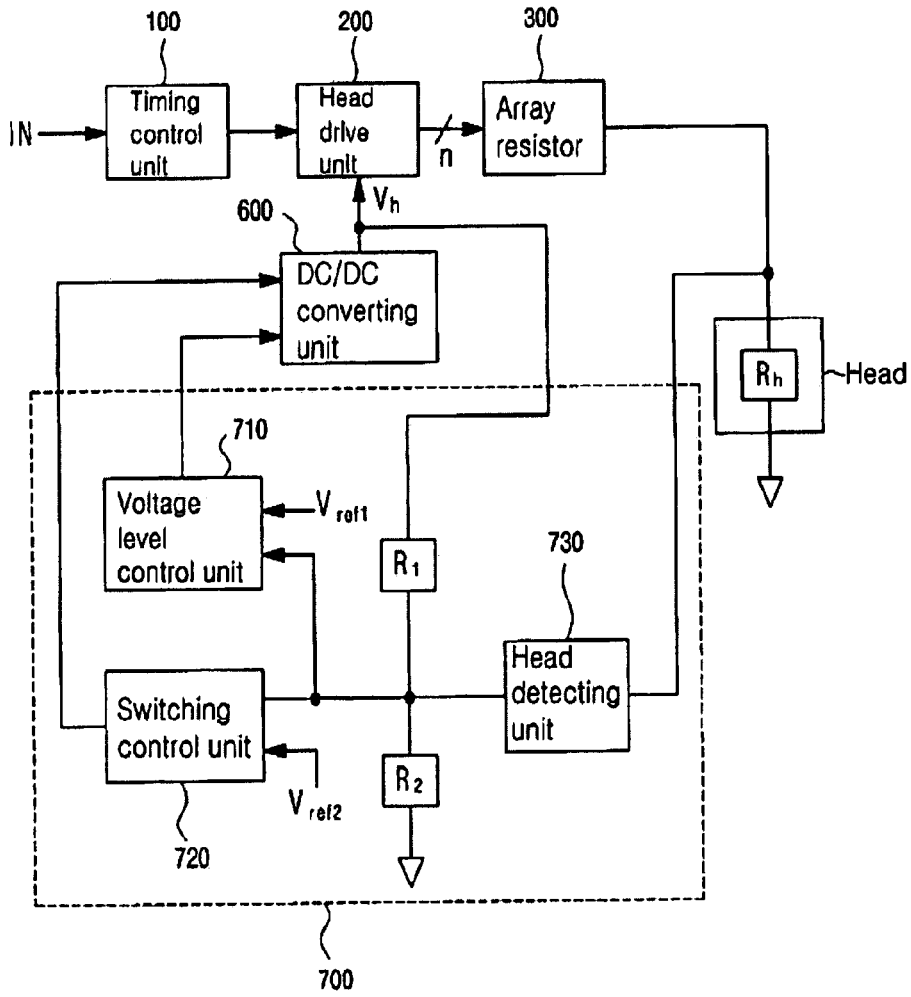
FIG. 5 is a block diagram of an apparatus for driving an ink jet printer for manufacturing a display device according to a first embodiment of the present invention.
Figure 6:
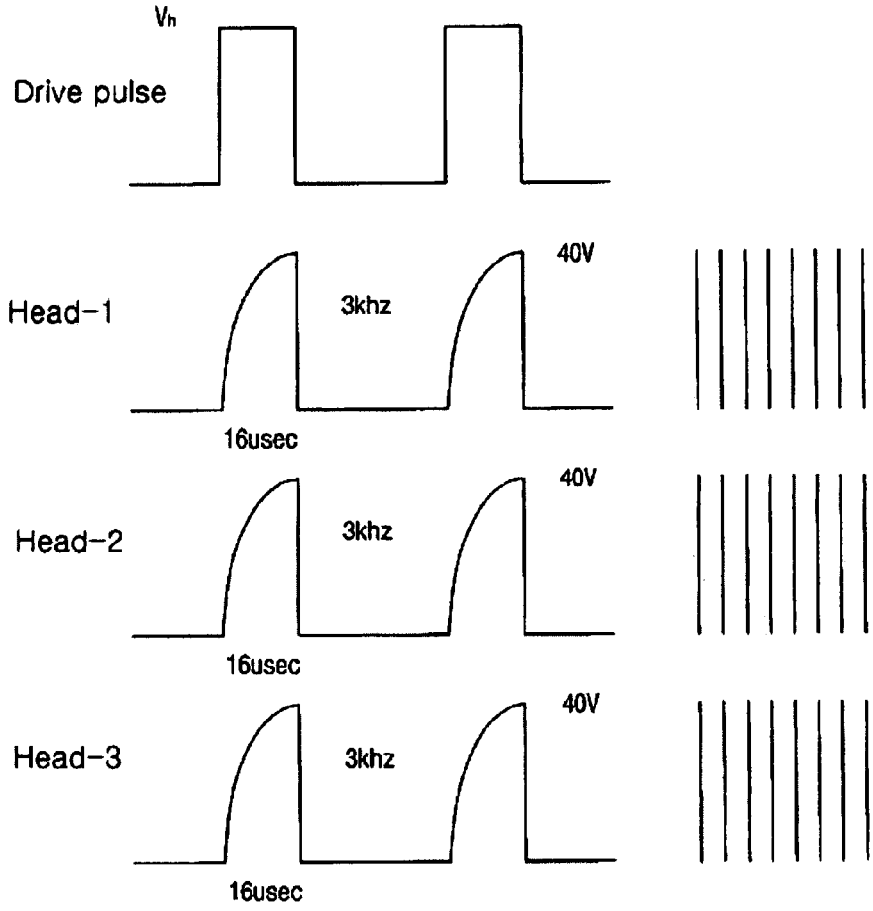
FIG. 6 is a diagram of a pattern according to a signal applied to each head of an apparatus for driving an ink jet printer for manufacturing a display device according to a first embodiment of the present invention.

FIG. 5 is a block diagram of an apparatus for driving an ink jet printer for manufacturing a display device according to a first embodiment of the present invention.

Referring to FIG. 5, an apparatus for driving an ink jet printer for manufacturing a display device according to a first embodiment of the present invention includes a DC/DC converting unit 600 outputting a prescribed drive voltage $V_h$ by receiving a switching control signal and a prescribed voltage level control signal, a timing control unit 100 outputting a timing control signal by receiving a prescribed signal IN inputted from outside, a head drive unit 200 receiving the timing control signal outputted from the timing control unit 100 and the prescribed drive voltage $V_h$ outputted from the DC/DC converting unit 600 to output a drive pulse at a level of the received voltage, an array resistor 300 receiving the drive pulse outputted from the head drive unit 200 to output a signal (head drive voltage) having a voltage at a prescribed level to a head, and an output voltage control unit 700 controlling to turn on/off the output voltage $V_h$ of the DC/DC converting unit 600 according to a presence or non-presence of a connection to a head and controlling an output voltage level of the DC/DC converting unit 600 to enable to output a predefined head drive voltage (e.g., 40V) according to a resistance of a resistor $R_h$ of a connected head.

The output voltage control unit 700 includes a head detecting unit 730 turning on/off the connection to the head by detecting the presence or non-presence of the connection to the head, first and second resistors $R_1$ and $R_2$ distributing the voltage $V_h$ outputted from the DC/DC converting unit 600, a switching control unit 720 outputting a switching-on/off control signal to the DC/DC converting unit 600 by receiving a voltage at the second resistor $R_2$ and a second reference voltage $V_{ref2}$, and a voltage level control unit outputting a prescribed voltage level control signal to the DC/DC converting unit 600 by receiving the voltage at the second resistor $R_2$ and a first reference voltage $V_{ref1}$ to enable the head drive unit 200 to output the predefined head drive voltage.

In this case, the voltage at the second resistor $R_2$ varies according to the presence or non-presence of the connection to the head. Once the head is connected, the head resistor $R_h$ and the second resistor $R_2$ are connected in parallel. Hence, the voltage at the second resistor $R_2$ in case of the presence of the connection to the head is much smaller than that in case of the non-presence of the connection to the head. And, the switching control unit 720 and the voltage level control unit 710 control the DC/DC converting unit 600 using the voltage at the second resistor $R_2$.

The switching control unit 720 can be configured using a differential amplifier and the voltage level control unit 710 can be configured using an error amplifier.

Preferably, the head detecting unit 730 includes a switching means (not shown in the drawing) for enabling a connection to the second resistor $R_2$ by detecting the presence or non-presence of the connection to the head. Preferably, the DC/DC converting unit 600 includes a switching means (not shown in the drawing) for deciding an output of the prescribed voltage $V_h$ by being turned on/off according to the switching control signal outputted from the switching control unit 720.

An operation of an apparatus for driving an ink jet printer for manufacturing a display device according to the first embodiment of the present invention is explained as follows.

First of all, once a prescribed signal IN for driving a printer is inputted from outside, the timing control unit 100 receives the external input signal and then outputs the timing control signal for driving a head.

The head drive unit 200 receives the timing control signal outputted from the timing control unit 100 and the prescribed drive voltage $V_h$ outputted from the DC/DC converting unit 600 and then outputs the drive pulse having the level of the received voltage Vh.

The drive pulse outputted from the head drive unit 200 is inputted to the array resistor 300 so that the head drive voltage having the prescribed converted voltage is inputted to the head.

From now on, the following assumptions are made to explain the present invention. In case that the head is connected, it is assumed that the voltage caught on the second resistor $R_2$ is Von. In case that the head is not connected, it is assumed that the voltage caught on the second resistor $R_2$ is Voff. In this case, the voltage Von is variable since the value of the head resistor $R_h$ varies according to the use and characteristic of the head.

First of all, in case that the head exists, the head detecting unit 730 detects that the head is connected via the resistance of the head resistor $R_h$ and then connects the second resistor $R_2$ to the head in parallel. Namely, the second resistor $R_2$ and the head resistor $R_h$ are connected parallel to each other.

The switching control unit 720 receives the second reference voltage $V_{ref2}$ and the voltage Von caught on the second resistor $R_2$ according to the parallel connection between the second resistor $R_2$ and the head resistor $R_h$, i.e., the voltage Von resulted from the voltage $V_h$ that is outputted from the DC/DC converting unit 600 to be applied between the second resistor $R_2$ and head resistor $R_h$ connected parallel to each other, and then outputs the switching-on control signal to the switching means provided to the DC/DC converting unit 600.

The voltage level control unit 710 receives the first reference voltage $V_{ref1}$ and the voltage $V_h$ caught on the second resistor $R_2$ and then the prescribed voltage level control signal corresponding to a difference between the two voltages to the DC/DC converting unit 600.

The DC/DC converting unit 600 receives the switching-on control signal outputted from the switching control unit 720 and the voltage level control signal outputted from the voltage level control unit 710 and then outputs the prescribed voltage $V_h$ corresponding to the voltage level control signal to the head drive unit 200.

Meanwhile, explained in the following are one case of the head drive voltage higher than the predefined head drive voltage (e.g., 40V) and the other case of the head drive voltage lower than the predefined head drive voltage (e.g., 40V).

Figure 3:
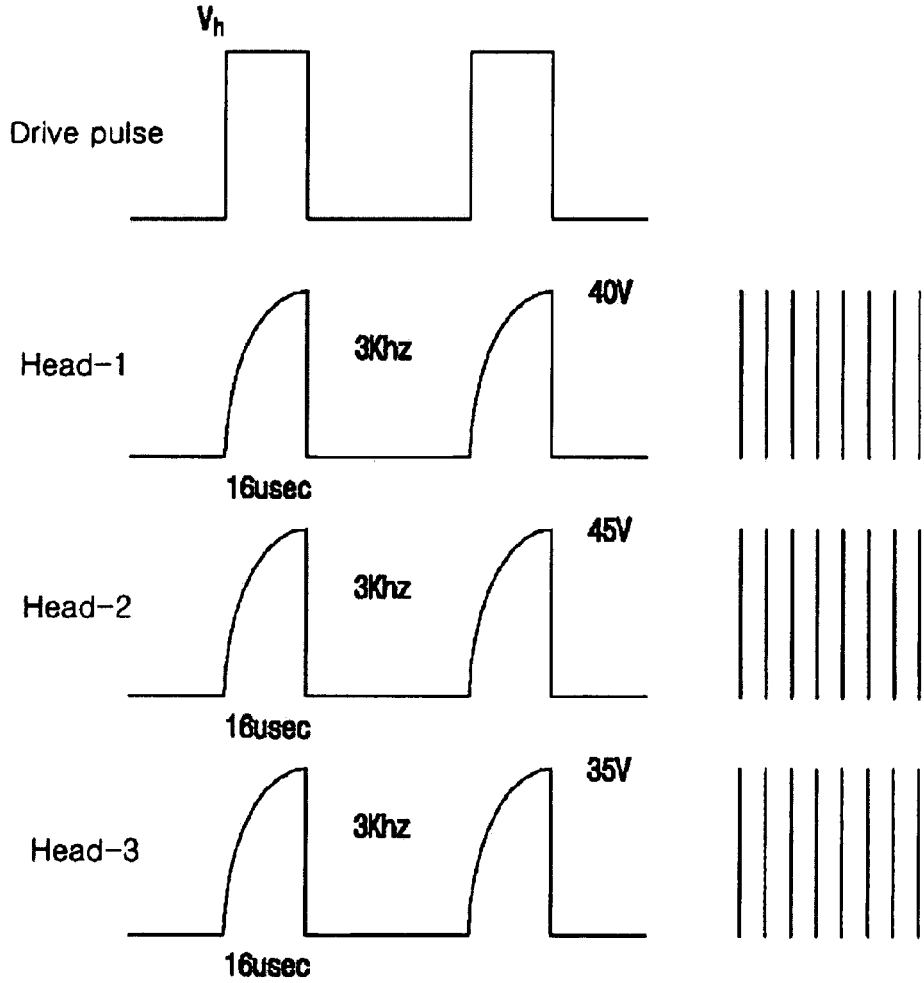
FIG. 3 is a diagram of a pattern according to a signal applied to each head of the related art device for driving the ink jet printer for display device fabrication.
Figure 4:
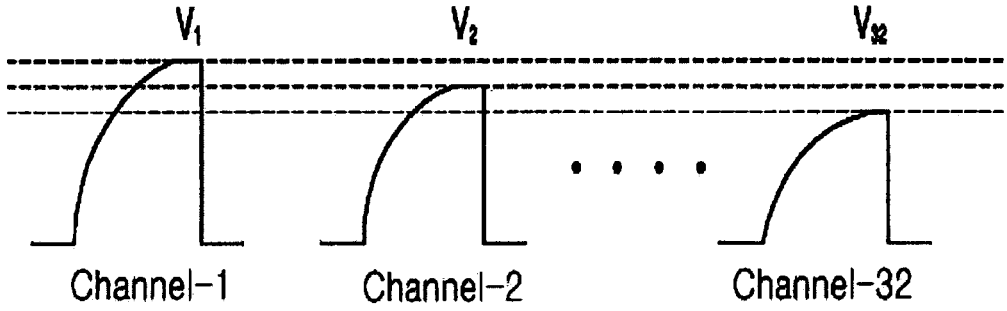
FIG. 4 is a diagram of a waveform applied to a piezo configuring each head of the related art device for driving the ink jet printer for display device fabrication.

For instance, assuming that the predefined head drive voltage is 40V, the cases of the head-2 (in case of the head drive voltage higher than the predefined head drive voltage) and the head-3 (in case of the head drive voltage lower than the predefined head drive voltage) shown in FIG. 3 are explained as follows.

In case of the head-2, since the head drive voltage is 45V that is higher than the predefined head drive voltage 40V, a voltage drop of 5V is necessary. Namely, the voltage level control unit 710 receives the first reference voltage and the voltage driven by the parallel connection between the resistor of the head-2 and the second resistor $R_2$ and then outputs the voltage level control signal for the voltage drop of 5V to the DC/DC converting unit 600. The DC/DC converting unit 600 receives the voltage level control signal for dropping the voltage by 5V and then outputs the corresponding prescribed voltage $V_h$, whereby the head drive voltage applied to the head-2 is lowered. By repetition of such a process, the impression of the head drive voltage applied to the head-2 can be achieved by the predefined head drive voltage of 40V.

On the other hand, in case of the head-3, since the head drive voltage is 35V that is lower than the predefined head drive voltage 40V, a voltage rise of 5V is necessary. Namely, the voltage level control unit 710 receives the first reference voltage and the voltage driven by the parallel connection between the resistor of the head-3 and the second resistor $R_2$ and then outputs the voltage level control signal for the voltage rise of 5V to the DC/DC converting unit 600. The DC/DC converting unit 600 receives the voltage level control signal for raising the voltage by 5V and then outputs the corresponding prescribed voltage $V_h$, whereby the head drive voltage applied to the head-3 is raised. By repetition of such a process, the impression of the head drive voltage applied to the head-3 can be achieved by the predefined head drive voltage of 40V.

Thus, by raising or lowering to compensate the head drive voltage applied to the head-1, head-2, or head-3 to fit the predefined head drive voltage, the compensated head drive voltage coincides with the predefined head drive voltage of 40V to cancel out the voltage difference between the heads. Hence, the patterns by the respective heads become uniform.

Meanwhile, if the head is not connected, the voltage Voff caught on the second resistor $R_2$ is raised. The switching control unit 720 receives the voltage Voff and the second reference voltage to output the switching-off control signal to the DC/DC converting unit 600.

The DC/DC converting unit 600 receives the switching-off control signal to turn off the prescribed voltage $V_h$ applied to the head drive unit 200. Namely, as the voltage is not applied to the head drive unit 200 unlike the related art device, the present invention enables to remove the bad influence put on the system.

Even if the prescribed voltage level control signal is outputted by the first reference voltage and the voltage Voff from the voltage level control unit 710 to the DC/DC converting unit 600, any influence is not put on the system since the switching means provided to the DC/DC converting unit 600 is turned off.

Besides, in the above-described apparatus of driving an ink jet printer for manufacturing a display device according to the first embodiment of the present invention, the head resistor $R_h$ may have the resistance value of the head itself or an average resistance of a plurality of piezos configuring a head that will be explained in another apparatus for driving an ink jet printer for manufacturing a display device according to the first embodiment of the present invention. Moreover, the predefined first and second reference voltages can be determined by a manufacturer of the corresponding display device.

Therefore, the apparatus of driving an ink jet printer for manufacturing a display device according to the first embodiment of the present invention enhances the uniformity of the pattern by equalizing the head drive voltage applied to the head even if the resistance differs according to the use and characteristic of the head.

Figure 7:
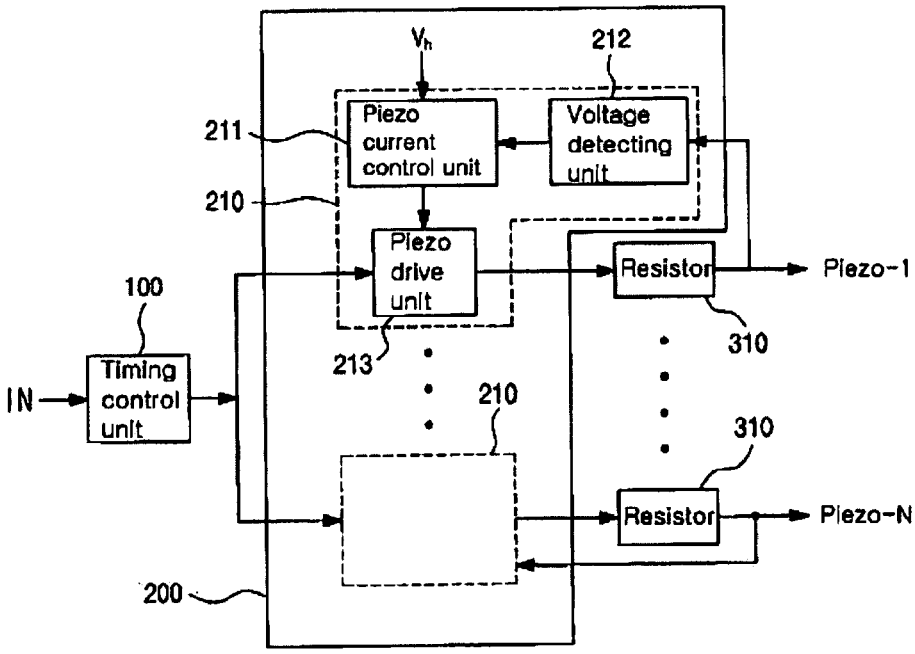
FIG. 7 is a block diagram of another apparatus for driving an ink jet printer for manufacturing a display device according to a first embodiment of the present invention.

FIG. 7 is a block diagram of another apparatus for driving an ink jet printer for manufacturing a display device according to a first embodiment of the present invention.

Referring to FIG. 7, another apparatus for driving an ink jet printer for manufacturing a display device according to a first embodiment of the present invention includes a timing control unit 100 receiving an external signal IN, e.g., trigger signal, for driving a head and outputting a prescribed timing control signal and a head drive unit 200 provided with a plurality of drive pulse applying units 210. And, each of the drive pulse applying units 210 generates a prescribed constant current by detecting a voltage of a drive waveform inputted to a piezo and applies a drive voltage $V_h$ inputted from outside and a drive pulse having the prescribed constant current to the piezo via resistor 310 by the timing control signal outputted from the timing control unit 100.

The drive pulse applying unit 210 includes a voltage detecting unit 212 outputting a prescribed voltage by detecting the voltage of the drive waveform applied to the piezo, a piezo current control unit 211 comparing the prescribed voltage outputted from the voltage detecting unit 212 to a predefined reference voltage $V_{ref}$ and outputting the constant current corresponding to a difference resulting from the comparison and the drive voltage $V_h$ inputted from outside, and a piezo drive unit 213 receiving the drive voltage $V_h$ and prescribed constant current outputted from the piezo current control unit 211 and applying the drive pulse having the drive voltage $V_h$ and the prescribed constant current to the piezo via the resistor 310 by the timing control signal outputted from the timing control unit 100.

In this case, the voltage detecting unit 212 integrates the drive waveform applied to the piezo, e.g., piezo-1, to convert to a constant DC voltage and then detects an inputted voltage using the converted voltage.

Figure 8:
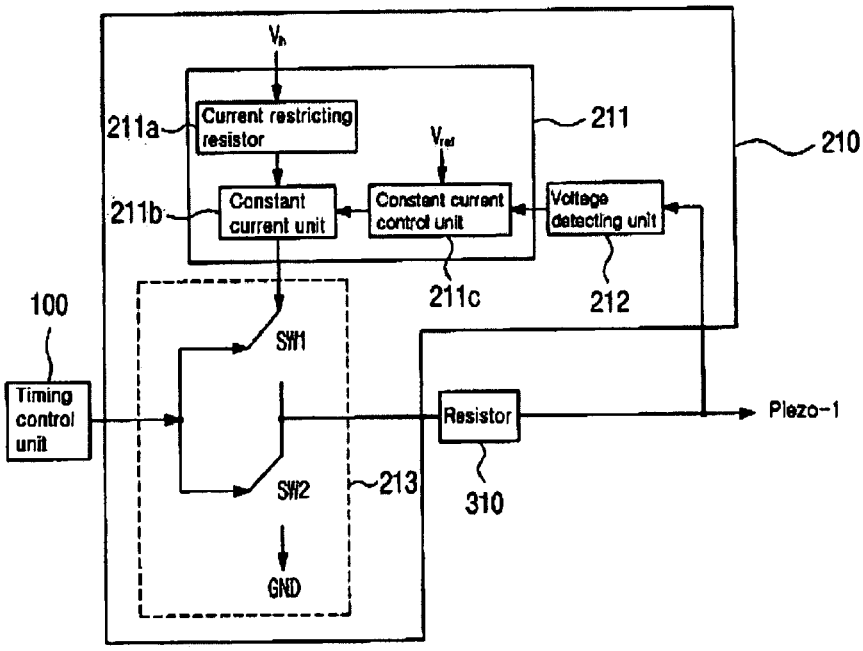
FIG. 8 is a detailed diagram of a drive pulse applying unit shown in FIG. 7.
Figure 9:
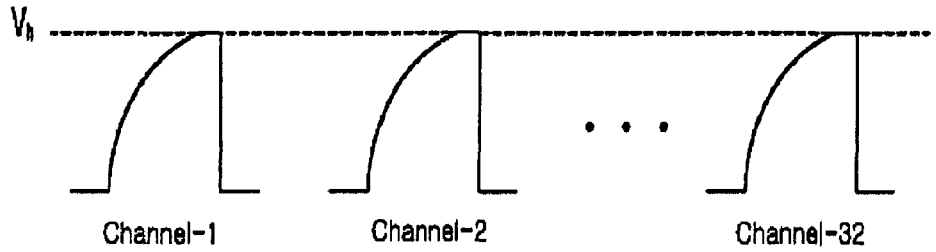
FIG. 9 is a diagram of a drive waveform applied to each channel of an apparatus for driving an ink jet printer for manufacturing a display device according to a first embodiment of the present invention.

FIG. 8 is a detailed diagram of the drive pulse applying unit 210 shown in FIG. 7. Referring to FIG. 8, the piezo current control unit 211 includes a constant current control unit 211*c* outputting a prescribed constant current control signal by comparing the prescribed voltage outputted from the voltage detecting unit 212 to the predetermined reference voltage $V_{ref}$ and a constant current unit 211*b* outputting the prescribed constant current by the drive voltage $V_h$ inputted via current restricting resistor 211*a* and the constant current control signal inputted from the constant current control unit 211*c*. And, the piezo drive unit 213 includes a plurality of switching means SW1 and SW2 for outputting the drive voltage $V_h$ and prescribed constant current outputted from the constant current unit 211*b* via the resistor 310 to the piezo.

An operation of another apparatus for driving an ink jet printer for manufacturing a display device according to the first embodiment of the present invention is explained with reference to FIG. 8 as follows.

First of all, once the trigger signal IN for jetting ink is inputted from outside, the timing control unit 100 outputs the prescribed timing control signal. And, the switching means SW1 and SW2 provided to the piezo drive unit 213 are turned on/off by the timing control signal so that the drive pulse having the drive voltage $V_h$ and prescribed constant current inputted from the constant current unit 211*b* to the piezo (piezo-1) via the resistor 310.

The voltage detecting unit 212 outputs the prescribed voltage by detecting the DC voltage resulting from integrating to convert the drive waveform inputted to the piezo. And, the constant current control unit 211*c* outputs the prescribed constant current control signal by comparing the prescribed voltage outputted from the voltage detecting unit 212 to the predefined reference voltage $V_{ref}$.

The constant current unit 211*b* outputs the prescribed constant current generated by the drive voltage $V_h$ inputted via the current restricting resistor 211*a* and the constant current control signal outputted from the constant current control unit 211*c*. And, the switching means SW1 and SW2 provided to the piezo drive unit 213 are turned on/off by the timing control signal outputted from the timing control unit 100 to apply the drive pulse having the drive voltage $V_h$ and prescribed constant current inputted from the constant current unit 211*b* to the piezo via the resistor 310. By repeating such an operational process, the drive waveform having the same voltage and slope is applied to each of the piezos, whereby the drive waveform having the same voltage (e.g., $V_h$) and slope can be applied to each channel.

The slope of the drive waveform applied to the piezo depends on a size of the constant current outputted from the constant current unit 21*b*. For instance, if a voltage size of the drive waveform detected by the voltage detecting unit 212 is small, i.e., if the voltage size of the drive waveform applied to the piezo is small, the constant current outputted from the constant current unit 211*b* is increased to raise the voltage of the drive waveform applied to the piezo.

Therefore, in the apparatus of driving an ink jet printer for manufacturing a display device according to the first embodiment of the present invention, the voltage of the waveform applied to each of the piezos is detected and the size of the constant current is controlled to enable to apply the waveform having the same voltage and slope to each of the piezos via the detected voltage. Namely, in case of the piezo smaller than the voltage of the predefined drive waveform, the size of the applied constant current is increased. And, in case of the piezo greater than the voltage of the predefined drive waveform, the size of the applied constant current is decreased. Hence, the waveform having the same voltage and slope is applied to each of the piezos.

Moreover, although not shown in the drawing, in the apparatus of driving an ink jet printer for manufacturing a display device according to the first embodiment of the present invention, a variable resistor is inserted in each channel and the inserted variable resistor is independently controlled. Therefore, it is able to apply the same drive waveform to each of the piezos.

Second Embodiment

According to a second embodiment of the present invention, an apparatus for driving an ink jet printer for manufacturing a display device includes a head drive unit driving at least one head by receiving a prescribed drive voltage to output a drive pulse via an array resistor, a time delay unit receiving a prescribed trigger signal for head driving and outputting a timing control signal delayed by a prescribed time, and a push/pull drive unit outputting a priming pulse via the array resistor to the head by the timing control signal outputted from the time delay unit, wherein the priming pulse having a same frequency of the head drive pulse circulates ink instead of jetting the ink.

The push/pull drive unit includes a buffer and inverter outputting switching-on/off signals by the timing control signal outputted from the time delay unit, respectively, a first switch controlled by the switching-on/off signal outputted from the buffer and outputting a priming voltage to the array resistor by the switching-on signal, and a second switch controlled by the switching-on/off signal outputted from the inverter and outputting a ground voltage (GND) to the array resistor by the switching-on signal.

According to a second embodiment of the present invention, a method of driving an ink jet printer for manufacturing a display device includes the steps of applying a drive pulse having a prescribed frequency and a drive voltage for printing ink to a head and applying a priming pulse having the prescribed frequency of the drive pulse and a prescribed priming voltage to the head after completion of applying the drive pulse.

And, a width of the priming pulse is smaller than that of the drive pulse.

Hereinafter, a second embodiment of the present invention will be described with reference to the drawings.

Figure 10:
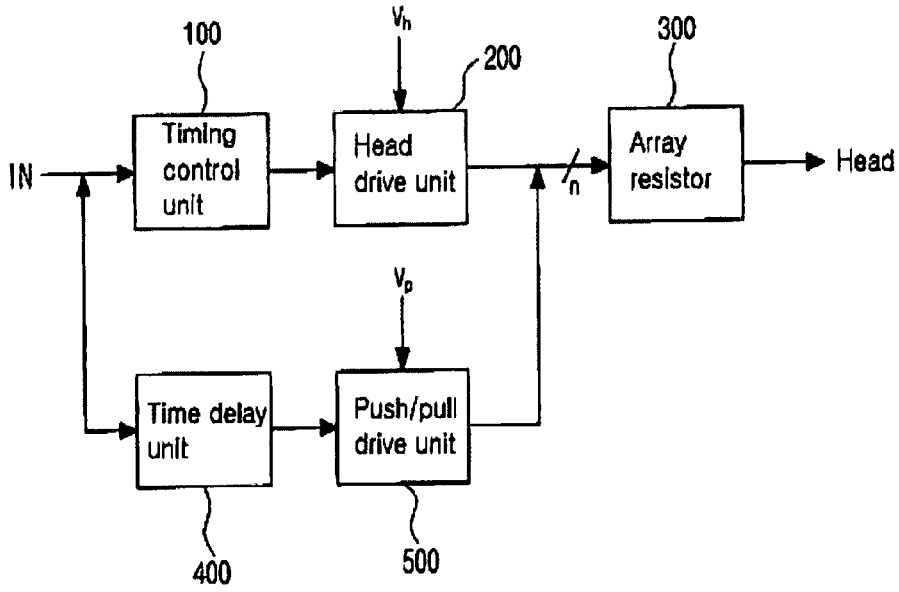
FIG. 10 is a block diagram of an apparatus for driving an ink jet printer for manufacturing a display device according to a second embodiment of the present invention.

FIG. 10 is a block diagram of an apparatus for driving an ink jet printer for manufacturing a display device according to a second embodiment of the present invention.

Referring to FIG. 10, an apparatus for driving an ink jet printer for manufacturing a display device according to a second embodiment of the present invention includes a timing control unit 100 receiving an external signal IN, e.g., trigger signal, for head driving and outputting a timing control signal having a prescribed frequency, a head drive unit 200 receiving the timing control signal outputted from the timing control unit 100 and a prescribed drive voltage $V_h$, e.g., 40V, from outside and outputting a drive pulse via array resistor 300, a time delay unit 400 receiving the external signal IN and outputting a prescribed time delayed timing signal having the same frequency of the timing control signal outputted from the timing control unit 100, and a push/pull drive unit 500 receiving the delayed timing control signal outputted from the time delay unit 400 and a prescribed priming voltage, $V_p$, e.g., 20V, from outside and outputting a priming pulse via the array resistor 300 to a head.

In this case, a width of the priming pulse applied to the array resistor 300 from the push/pull drive unit 500 can be equal to or smaller than that of the drive pulse applied to the array resistor 300 from the head drive unit 200.

Figure 11:
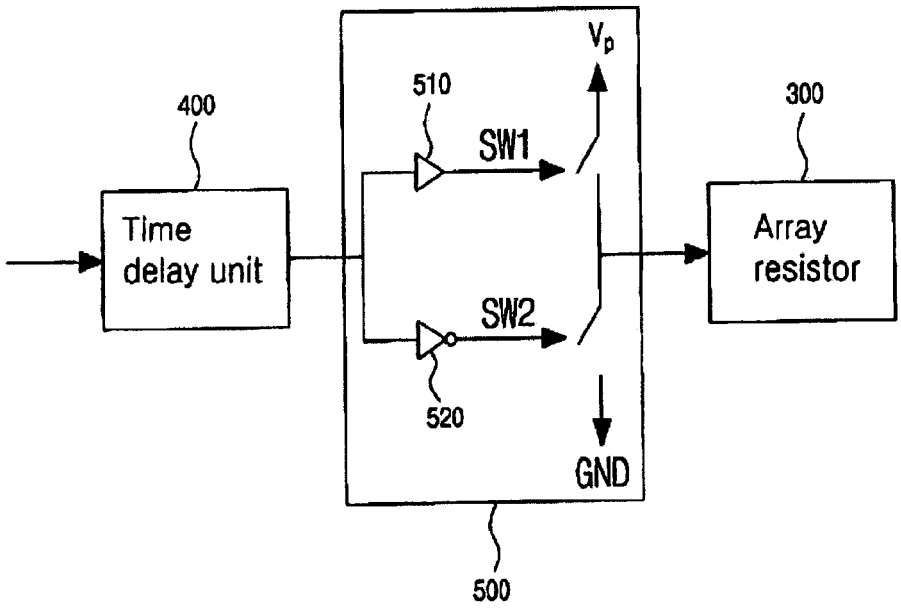
FIG. 11 is a detailed block diagram of a push/pull drive unit shown in FIG. 10.

FIG. 11 is a detailed block diagram of the push/pull drive unit 500 shown in FIG. 10.

Referring to FIG. 11, the push/pull drive unit 500 includes a buffer 510 and inverter 520 outputting switching-on/off signals by the timing control signal outputted from the time delay unit 400, respectively, a first switch SW1 controlled by the switching-on/off signal outputted from the buffer 510 and outputting a priming voltage to the array resistor 300 by the switching-on signal, and a second switch SW2 controlled by the switching-on/off signal outputted from the inverter 520 and outputting a ground voltage GND to the array resistor 300 by the switching-on signal.

An operation of a method of driving an ink jet printer for manufacturing a display device according to the second embodiment of the present invention is explained as follows.

Figure 12:
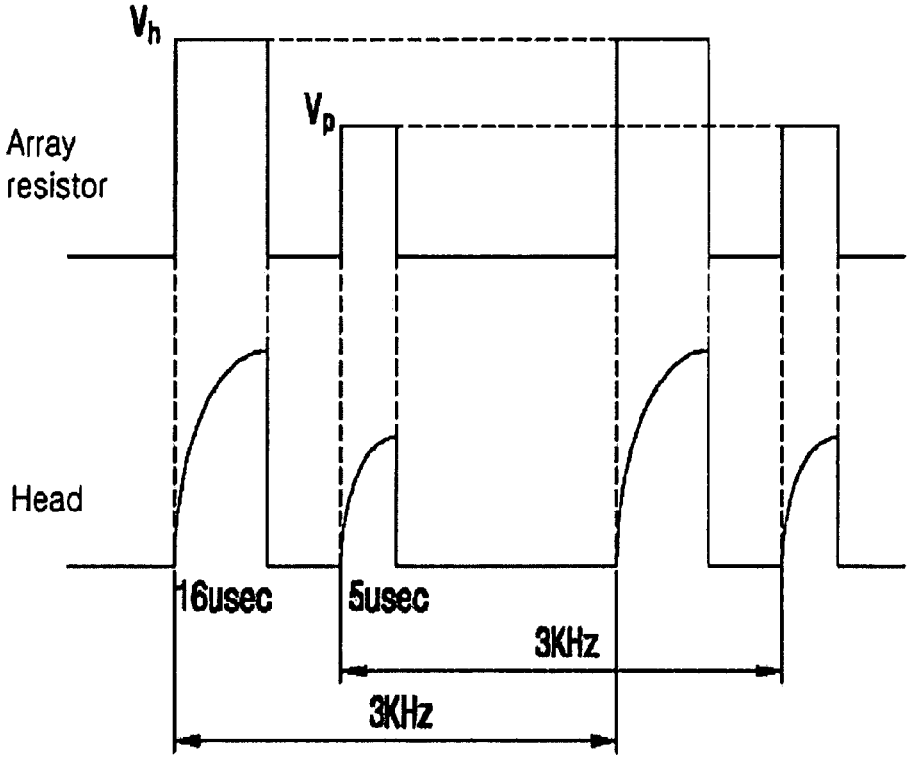
FIG. 12 is a diagram for explaining a method of driving an ink jet printer for manufacturing a display device according to a second embodiment of the present invention.

First of all, once the trigger signal IN for jetting ink is inputted from outside, the timing control unit 100 outputs the prescribed timing control signal having the prescribed frequency, e.g., 3 KHz. The head drive unit 200 receives the timing control signal outputted from the timing control unit 100 and the prescribed drive voltage inputted from outside, e.g., the prescribed drive voltage $V_h$ outputted from the DC/DC converting unit, and then outputs the drive pulse, as shown in FIG. 12, having the prescribed drive voltage $V_h$.

The drive pulse outputted from the head drive unit 200 is passed through the array resistor 300 to be converted to a prescribed signal by a resistance of the array resistor 300 and a condenser value existing in the head. And, the head is then driven by the converted signal to jet the ink.

In doing so, after the drive pulse having the drive voltage Vh has been applied to the head, the ink is not injected. Instead, the priming pulse, which has the same frequency of the drive pulse but is delayed by the prescribed time, is applied thereto to circulate the ink instead of jetting the ink under the same condition.

A process of applying the priming pulse is explained in detail as follows.

First of all, First of all, once the trigger signal IN for jetting ink is inputted from outside, the time delay unit 400 outputs the timing control signal, which has the same frequency, e.g., 3 KHz, of the timing control signal outputted from the timing control unit 100 but is delayed by a prescribed time. In this case, the prescribed delayed time can be determined by a printer manufacturer to depend on circumstances.

The buffer 510 and inverter 520 having received the timing control signal outputted from the time delay unit 400 output the switching-on or switching-off signal. The first and second switches SW1 and SW2 receive the switching-on or switching-off signal outputted from the buffer 510 and inverter 520 to output the priming voltage $V_p$ and the ground voltage GND, respectively. For instance, if the buffer 510 and the inverter 520 output the switching-on signal and the off-off signal during a prescribed time (e.g., 5 μsec), respectively, the first switch SW1 is turned on but the second switch SW2 is turned off. Hence, the priming voltage $V_p$ is outputted to the array resistor 300. On the other hand, if the buffer 510 and the inverter 520 output the switching-off signal and the switching-on signal during a prescribed time (e.g., 5 μsec), respectively, the first switch SW1 is turned off but the second switch SW2 is turned on. Hence, the ground voltage GND is outputted to the array resistor 300.

Through the above-explained process, the priming pulse, which is delayed by the prescribed time to be later than the drive pulse, is outputted to the array resistor 300. And, the outputted priming pulse is passed through the array resistor 300 to be converted to the prescribed signal by the resistance of the array resistor 300 and the condenser value existing in the head.

FIG. 12 is a diagram of the drive and priming pulses outputted to the array resistor 300 and the head via the above-explained process. Referring to FIG. 12, the frequency of the drive pulse is equal to that of the priming pulse. Yet, the pulse width and voltage of the drive pulse are different from those of the priming pulse. If the priming pulse having the same frequency of the drive pulse is applied to the head, the ink fails to be jetted but keeps circulating. Hence, it is able to prevent the nozzle from being blocked or the missing channel from occurring.

Accordingly, in the apparatus of driving an ink jet printer for manufacturing a display device and method thereof according to the second embodiment of the present invention, the frequency of the drive pulse outputted from the head drive unit is equal to that of the priming pulse outputted from the push/pull drive unit. Yet, the drive pulse differs from the priming pulse in voltage. And, the voltages and frequencies of the drive and priming pulses are variable according to circumstances.

Moreover, in the apparatus of driving an ink jet printer for manufacturing a display device and method thereof according to the second embodiment of the present invention, the push/pull drive unit applying the priming pulse to the array resistor includes the switches, thereby simplifying its configuration and barely needing any power consumption.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An apparatus of driving an ink jet printer for manufacturing a display device, comprising:

a timing control unit outputting a timing control signal by receiving a prescribed signal (IN) inputted from outside;

a head drive unit receiving the timing control signal outputted from the timing control unit and a prescribed drive voltage (Vh), the head drive unit outputting a drive pulse of a predetermined voltage level; and an array resistor outputting a head drive voltage to each of a plurality of piezos included in a plurality of heads by receiving the drive pulse outputted from the head drive unit, wherein the head drive voltage outputted from the array resistor maintains a predefined voltage value, wherein the head drive unit includes a plurality of drive pulse applying units, and wherein each of the drive pulse applying units generates a prescribed constant current by detecting a pulse of the drive voltage inputted to a respective piezo and applies the prescribed drive voltage ($V_h$) and a drive pulse having the prescribed constant current to the respective piezo via the resistor based on the received timing control signal.

2. The apparatus of claim 1, wherein the prescribed drive voltage (Vh) is supplied from a DC/DC converting unit and an output voltage control unit so that the head drive voltage outputted from the array resistor is maintained at the predefined voltage value by the head drive unit.

3. The apparatus of claim 2, wherein the DC/DC converting unit outputs the prescribed drive voltage to the head drive unit by receiving a switching control signal and a voltage level control signal, wherein the output voltage control unit outputs a switching-on/off control signal according to a presence or a non-presence of a connected state of the head to the DC/DC converting unit by receiving the prescribed drive voltage outputted from the DC/DC converting unit, and wherein the output voltage control unit outputs the voltage level control signal to the DC/DC converting unit to enable the head drive unit to output the head drive voltage in case of the presence of the connected state of the head.

4. The apparatus of claim 3, wherein the output voltage control unit includes:

a head detecting unit turning on/off a connection to the head by detecting the presence or the non-presence of the connected state of the head;

first and second resistors distributing the drive voltage (Vh) outputted from the DC/DC converting unit;

a switching control unit outputting the switching-on/off control signal to the DC/DC converting unit by receiving a voltage from the second resistor and a predefined second reference voltage (Vref2); and a voltage level control unit outputting the prescribed voltage level control signal to the DC/DC converting unit by receiving the voltage from the second resistor and a predefined first reference voltage (Vref1) to enable the head drive unit to output the predefined head drive voltage.

5. The apparatus of claim 4, wherein in case that the connection to the head is turned on, a resistor of the connected head and the second resistor are connected in parallel.

6. The apparatus of claim 1, wherein each drive pulse applying unit includes:

a voltage detecting unit outputting a prescribed voltage by detecting the pulse of the head drive voltage applied to the respective piezo;

a piezo current control unit comparing the prescribed voltage outputted from the voltage detecting unit to a predefined reference voltage (Vref) and outputting the constant current corresponding to a difference resulting from the comparison and the drive voltage ($V_h$) inputted from outside; and a piezo drive unit receiving the drive voltage ($V_h$) and the prescribed constant current outputted from the piezo current control unit and applying the drive pulse having the drive voltage ($V_h$) and the prescribed constant current to the respective piezo via the respective resistor by the timing control signal inputted from outside.

7. The apparatus of claim 6, wherein the piezo current control unit includes:

a constant current control unit outputting a prescribed constant current control signal by comparing the prescribed voltage outputted from the voltage detecting unit to the predefined reference voltage (Vref); and a constant current unit outputting the prescribed constant current generated from the prescribed drive voltage ($V_h$) inputted from outside and the constant current control signal inputted from the constant current control unit to the piezo drive unit.

8. The apparatus of claim 6, wherein the piezo drive unit includes a plurality of switching means for outputting the drive voltage ($V_h$) and the prescribed constant current outputted from the constant current unit via the respective resistor to the respective piezo by being controlled by the timing control signal inputted from outside.

9. An apparatus comprising:

a timing control unit to output a timing control signal;

a head drive unit to receive the timing control signal and a drive voltage, the head drive unit to output a drive pulse of a predetermined voltage level;

an array resistor to output a head drive voltage to a plurality of heads by receiving the drive pulse, wherein the head drive voltage output from the array resistor maintains a predefined voltage value;

a DC/DC converting unit to provide the drive voltage by receiving a switching control signal and a voltage level control signal; and an output voltage control unit to output the switching control signal to the DC/DC converting unit according to a presence or a non-presence of a connected state of one of the heads based on the drive voltage received from the DC/DC converting unit, and wherein the output voltage control unit outputs the voltage level control signal to the DC/DC converting unit to enable the head drive unit to output the head drive voltage in case of the presence of the connected state of the head.

10. The apparatus of claim 9, wherein the output voltage control unit includes:

a head detecting unit to turn on/off a connection to one of the heads by detecting the presence or the non-presence of the connected state of the one of the heads;

first and second resistors to distribute the drive voltage outputted from the DC/DC converting unit;

a switching control unit to output the switching control signal to the DC/DC converting unit based on a voltage from the second resistor and a predefined first reference voltage; and a voltage level control unit to output the voltage level control signal to the DC/DC converting unit based on the voltage from the second resistor and a second reference voltage to enable the head drive unit to output the head drive voltage.

11. The apparatus of claim 10, wherein a resistor of the connected head and the second resistor are connected in parallel when the connection to the one of the heads is turned on.

12. The apparatus of claim 9, wherein the head drive unit includes a plurality of drive pulse applying units each including:

a voltage detecting unit to output a prescribed voltage by detecting the pulse of the head drive voltage applied to a respective piezo;

a piezo current control unit to compare the prescribed voltage outputted from the voltage detecting unit to a predefined reference voltage and outputting a constant current corresponding to a difference resulting from the comparison and the drive voltage; and a piezo drive unit to receive the drive voltage and the prescribed constant current outputted from the piezo current control unit and to apply the drive pulse having the drive voltage and the prescribed constant current to the respective piezo via the respective resistor based on the timing control signal.

13. The apparatus of claim 12, wherein the piezo current control unit includes:

a constant current control unit to output a constant current control signal by comparing the prescribed voltage outputted from the voltage detecting unit to the predefined reference voltage; and a constant current unit to output the constant current generated from the drive voltage and the constant current control signal inputted from the constant current control unit to the piezo drive unit.

14. The apparatus of claim 12, wherein the piezo drive unit includes a plurality of switching means for outputting the drive voltage and the constant current outputted from the constant current unit via the respective resistor to the respective piezo based on the timing control signal.

* * * * *

UNITED STATES PATENT AND TRADEMARK OFFICE

CERTIFICATE OF CORRECTION

PATENT NO. : 7,318,634 B2
APPLICATION NO. : 10/974978
DATED : January 15, 2008
INVENTOR(S) : Seong Hak Moon It is certified that error appears in the above-identified patent and that said Letters Patent is hereby corrected as shown below:

In the title on the Title Page & Col. 1 of the patent the second occurrence "AND" should read --AN--.

The title should read:

(54) APPARATUS AND METHOD OF DRIVING AN INK JET PRINTER FOR MANUFACTURING A DISPLAY DEVICE

Signed and Sealed this

Sixth Day of May, 2008

JON W. DUDAS
*Director of the United States Patent and Trademark Office*